US012312744B2

(12) United States Patent
Bouthillette et al.

(10) Patent No.: US 12,312,744 B2
(45) Date of Patent: May 27, 2025

(54) BRACKET FOR A PIVOT ROD IN A DOCTOR ARRANGEMENT AND DOCTOR ARRANGEMENT FOR A FIBER WEB MACHINE

(71) Applicant: Valmet Technologies Oy, Espoo (FI)

(72) Inventors: David Bouthillette, Beloit, WI (US); Stephane Lecuyer, Trois-Rivieres (CA); Jonathan Olszak, Beloit, WI (US)

(73) Assignee: Valmet Technologies Oy, Espoo (FI)

( * ) Notice: Subject to any disclaimer, the term of this patent is extended or adjusted under 35 U.S.C. 154(b) by 240 days.

(21) Appl. No.: 18/178,133

(22) Filed: Mar. 3, 2023

(65) Prior Publication Data

US 2024/0084510 A1 Mar. 14, 2024

Related U.S. Application Data

(60) Provisional application No. 63/320,493, filed on Mar. 16, 2022.

(30) Foreign Application Priority Data

Mar. 18, 2022 (FI) ..... 20225242

(51) Int. Cl.
*D21G 3/00* (2006.01)

(52) U.S. Cl.
CPC ..... *D21G 3/005* (2013.01)

(58) Field of Classification Search
CPC ..... D21G 3/005; D21G 3/02; D21G 3/04
See application file for complete search history.

(56) References Cited

U.S. PATENT DOCUMENTS

| | | | | | |
|---|---|---|---|---|---|
| 3,859,690 | A * | 1/1975 | Brown | D21G 3/005 | 15/256.51 |
| 4,665,859 | A * | 5/1987 | Dunlap | D21G 3/005 | 118/261 |
| 5,279,710 | A * | 1/1994 | Aikawa | D21G 3/005 | 15/256.51 |
| 7,867,364 | B2 * | 1/2011 | Leeman | D21G 3/005 | 15/256.51 |
| 8,321,992 | B2 * | 12/2012 | Gauvin | D21G 3/005 | 15/256.51 |
| 11,834,790 | B2 * | 12/2023 | Johnson | D21G 3/005 | |
| 2008/0190579 | A1 * | 8/2008 | Leeman | D21G 3/005 | 162/312 |
| 2009/0148208 | A1 * | 6/2009 | Gauvin | D21G 3/005 | 399/351 |
| 2024/0102244 | A1 * | 3/2024 | Lecuyer | D21G 3/005 | |

FOREIGN PATENT DOCUMENTS

| | | | | |
|---|---|---|---|---|
| EP | 4343060 | A2 * | 3/2024 | D21G 3/005 |
| WO | 2009063132 | A1 | 5/2009 | |

* cited by examiner

*Primary Examiner* — Dennis R Cordray
(74) *Attorney, Agent, or Firm* — James Earl Lowe, Jr.

(57) ABSTRACT

The invention relates to a bracket for a pivot rod in a doctor arrangement. The bracket has a base with a mounting aperture and adjacent ears with a hole for a pivot rod arranged perpendicular to the base. The bracket is a cast or 3D-printed piece. The invention also relates a doctor arrangement for a fiber web machine.

15 Claims, 5 Drawing Sheets

Figure 1:
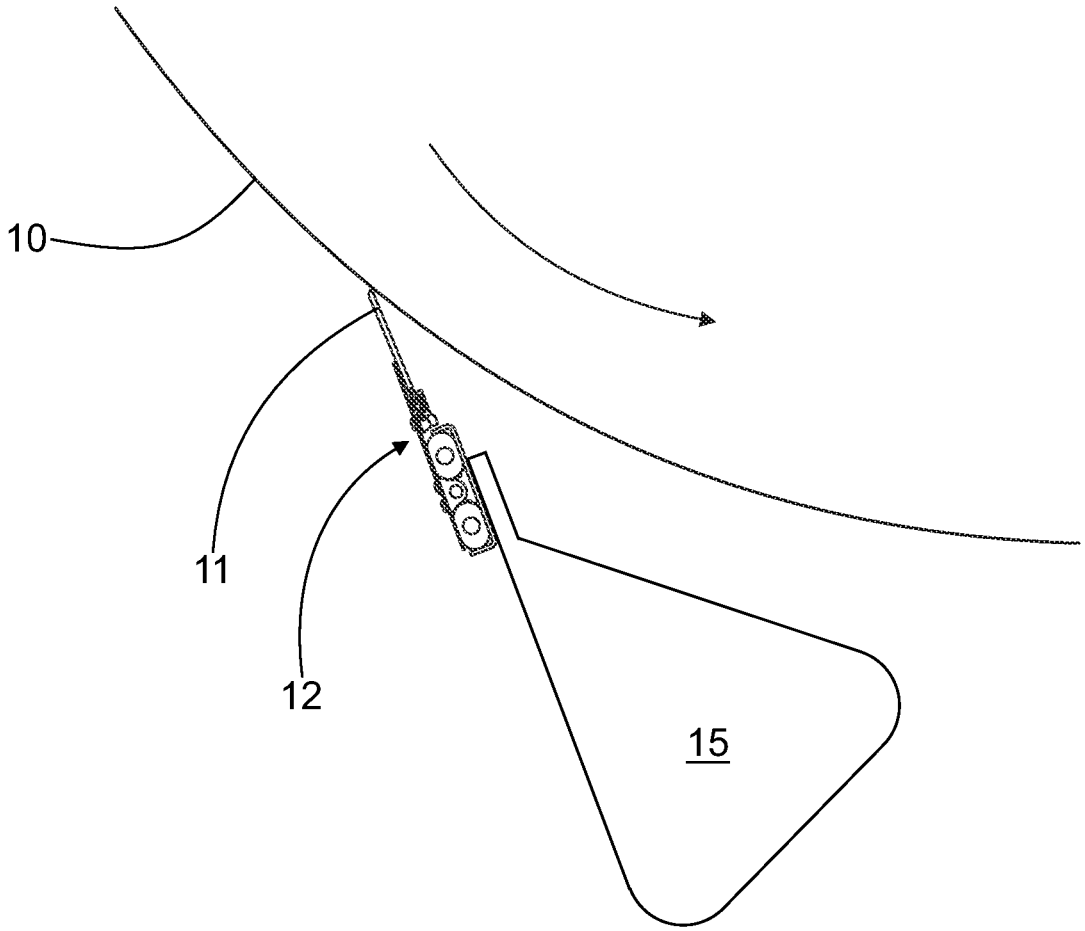

BRACKET FOR A PIVOT ROD IN A DOCTOR ARRANGEMENT AND DOCTOR ARRANGEMENT FOR A FIBER WEB MACHINE

The invention relates to a bracket for a pivot rod in a doctor arrangement, which bracket has a base with a mounting aperture and adjacent ears with a hole for a pivot rod arranged perpendicular to the base. The invention also relates to a doctor arrangement for a fiber web machine.

U.S. Pat. No. 5,279,710 discloses a doctor blade supporting structure for paper making rolls. Generally, the doctor blade is for cleaning the roll surface of a roll in a fiber web machine. Depending on the position, the doctor blade also removes water or the fiber web itself. The roll surface may be smooth, grooved or drilled, for example. The supporting structure includes a blade holder which is pivotally fixed to a doctor beam, for example. Here, the blade holder includes several parallel loading fingers which are screwed to a top plate. Then there are brackets fixed to the doctor beam at the point of each loading finger. The bracket has a base with a mounting aperture and adjacent ears with a hole. While the fingers and brackets are targeted to each other a pivot rod is led though the holes and the loading fingers. Thus the blade holder can be pivoted in relation to the doctor beam. For pivoting, there are loading tubes in connection with the top plate.

The blade holders position the doctor blade firmly against the roll, accommodate roll surface irregularities, facilitate rapid blade changes, and, within limits, compensate for thermal expansion. Proper doctoring is critical to many industrial processes like fiber web production.

The known brackets are manufactured from sheet metal. A strip of sheet metal is first stamped and then bent as a U-shape bracket. Thereby there are two ears per bracket for supporting the pivot rod. The bracket has also a base with a mounting aperture. Thus one mounting bolt supports the bracket. Usually, there are mounting bolts in 150 mm intervals.

In practice, one or more brackets will break in the corners, i.e. at the point where the base changes to the ears. First, the stress from the bending of the sheet metal weakens the structural integrity. At the same time, the highest stress points locate at the corners. The sheet metal is also too thin and is prone to stress corrosion cracking. The brackets hold the whole blade holder. If the brackets break, the blade holder will loosen. Also the corners and edges of the bracket are sharp and will easily damage the loading tubes. At the same time, the brackets do not support or help the loading tubes maintain their shape on the sides. This reduces the amount of travel the loading tube can move up and down to load and unload the doctor blade. In practice, one mounting bolt and two ears provide improper support to the top plate for uniform loading across a 150 mm span. Thus the top plate and the pivot rod may bend which further increases the stress to the brackets.

It is an object of the invention to provide a novel bracket for a pivot rod in a doctor arrangement with proper durability and load capacity. Another object of the invention is to provide a novel doctor arrangement for a fiber web machine which arrangement is simple and compact but has rigid support for the blade holder and can be utilized in various positions and with different doctor blades. The arrangement can be made lower and to contour adjacent loading tubes which enhances loading actions. The characteristic features of the bracket and the doctor arrangement according to this invention are stated in the accompanying Claims. The bracket is manufactured in a new way, and it has unique properties. In this way, the doctor arrangement functions accurately and is long lasting. With a new kind of bracket, the doctor arrangement remains simple, and it is easy to place even in tight or in other ways demanding positions.

Figure 2A:
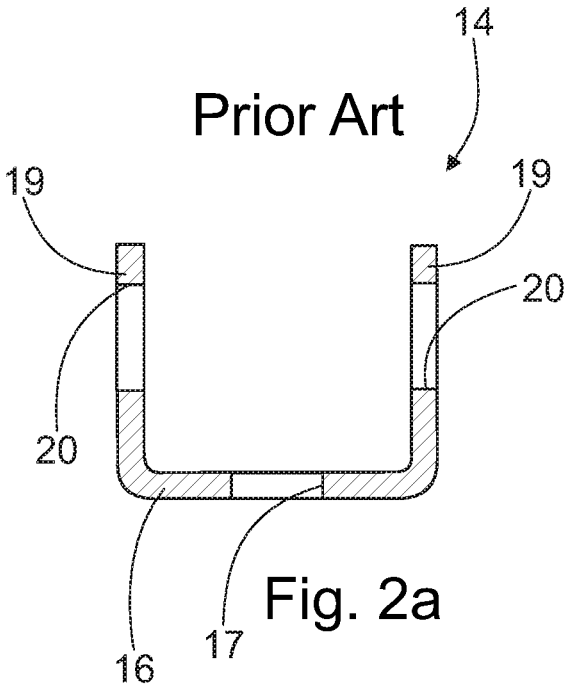
Figure 2B:
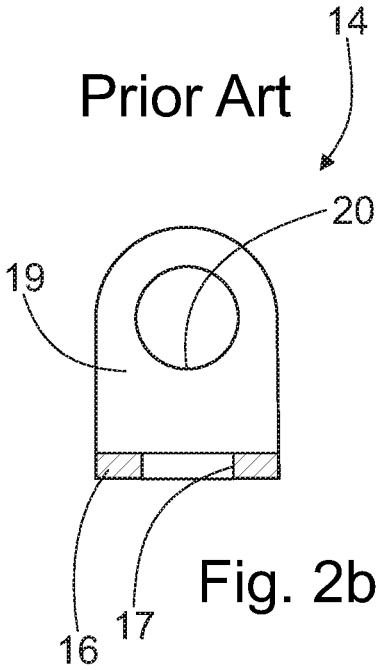
Figure 2C:
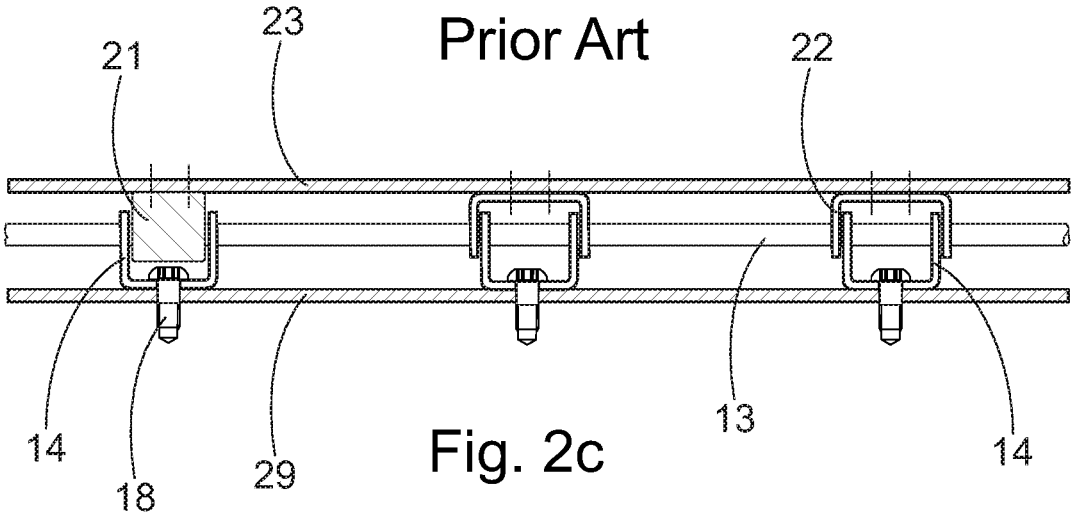
Figure 3A:
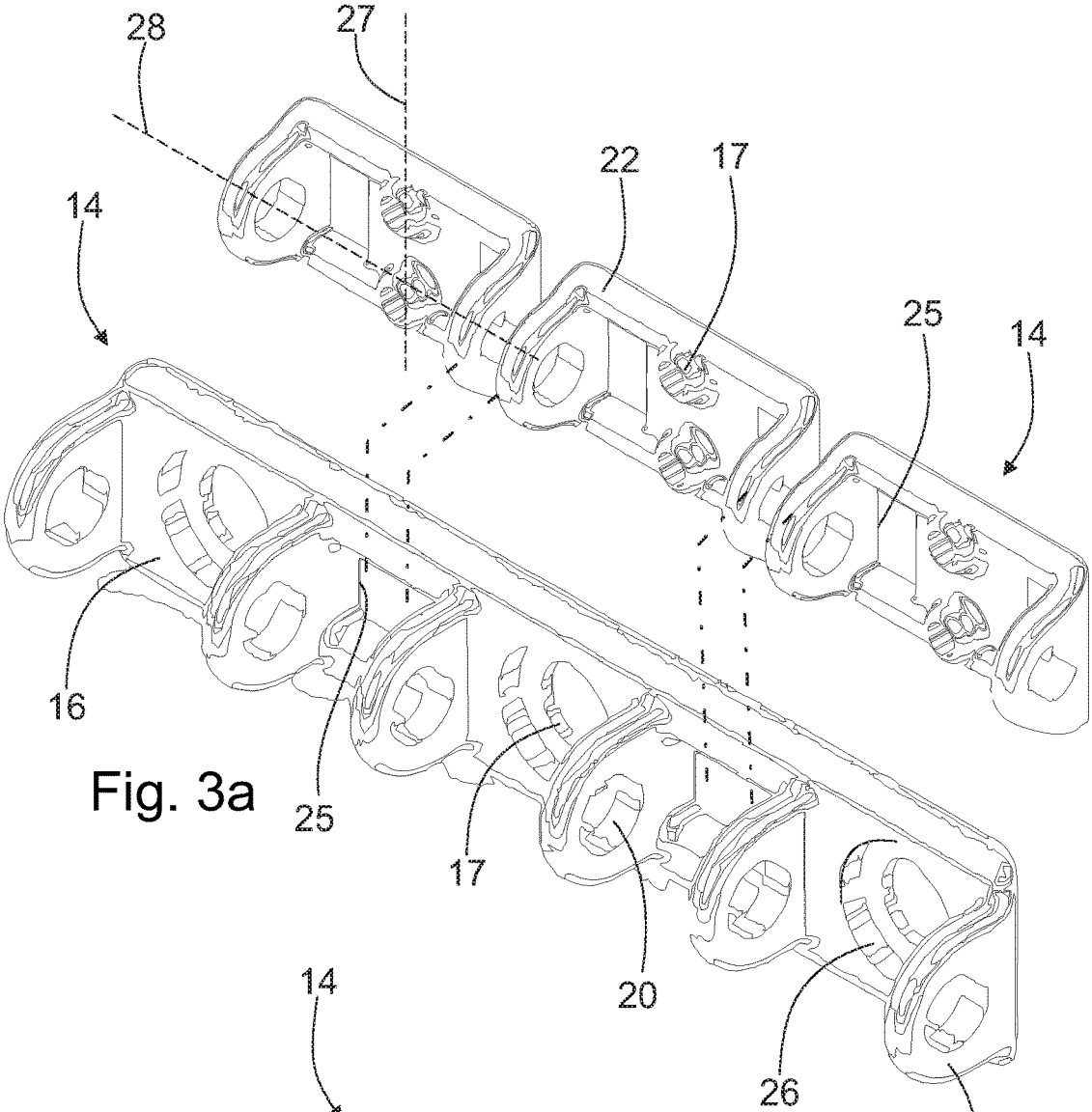
Figure 3B:
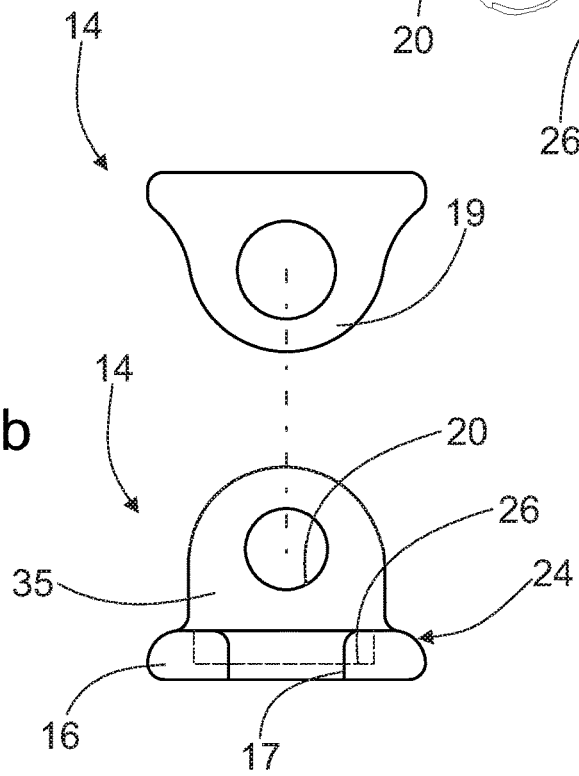

The invention is described below in detail by referring to the enclosed drawings which illustrate some of the embodiments of the invention, in which FIG. 1 shows a doctor arrangement according to the invention adapted to the vicinity of a surface to be doctored, FIG. 2*a* shows a cross section of one known bracket seen from the front, FIG. 2*b* shows a cross section of the bracket of FIG. 2*a* seen from the side, FIG. 2*c* shows a cross section of one known doctor arrangement seen in the machine direction, FIG. 3*a* shows the brackets according to the invention in 3D, FIG. 3*b* shows a side view of the brackets of FIG. 3*a,*

Figure 4A:
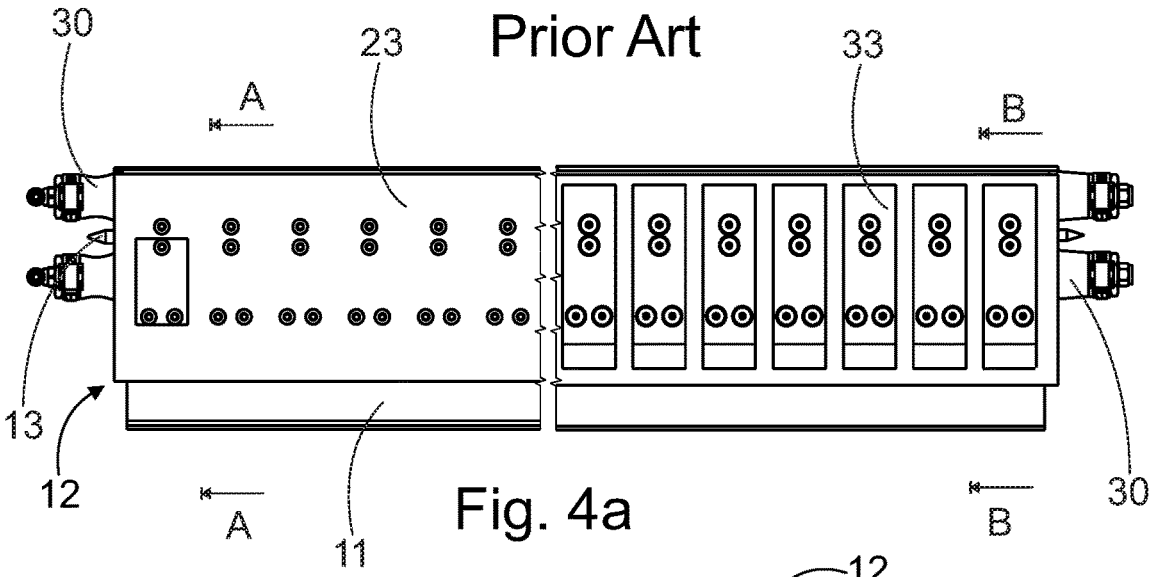
Figure 4B:
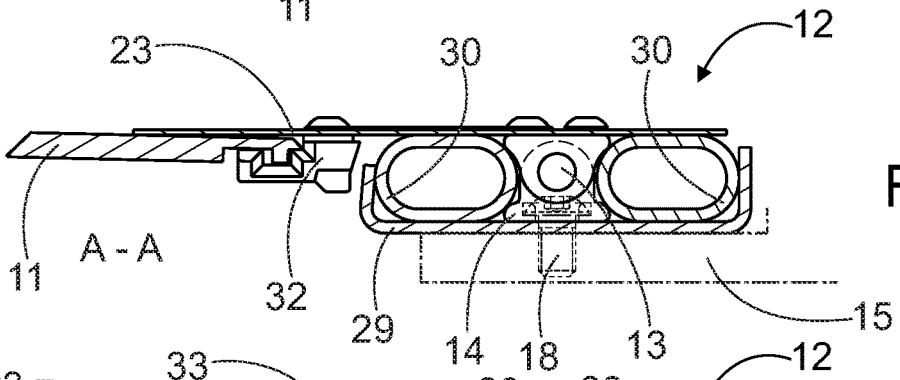

FIG. 4*a* shows a top view of the doctor arrangement according to the invention including two embodiments, FIG. 4*b* shows a cross section from line A-A of FIG. 4*a,*

Figure 4C:
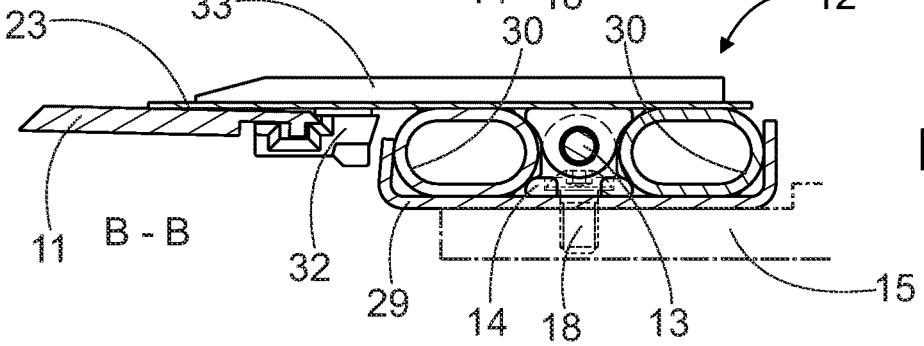

FIG. 4*c* shows a cross section from line B-B of FIG. 4*a,*

Figure 4D:
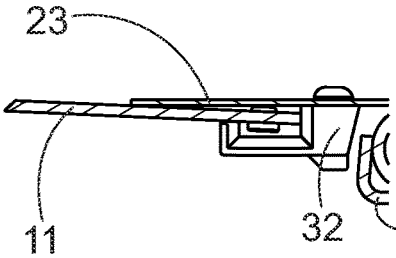

FIG. 4*d* shows a modification of FIG. 4*b,*

Figure 4E:
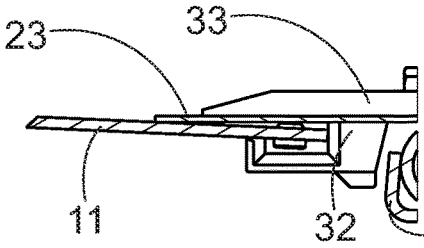

FIG. 4*e* shows a modification of FIG. 4*c,*

Figure 5A:
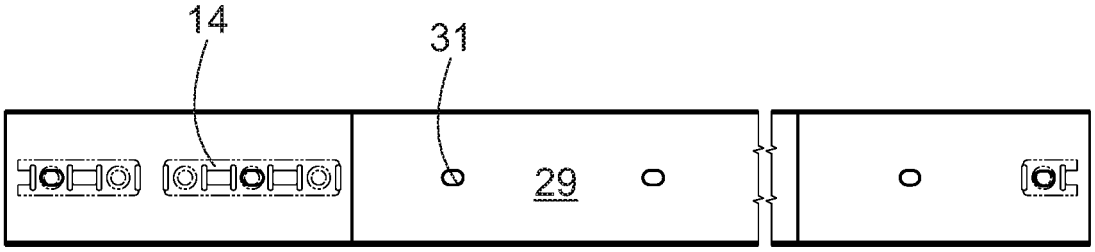
Figure 5B:
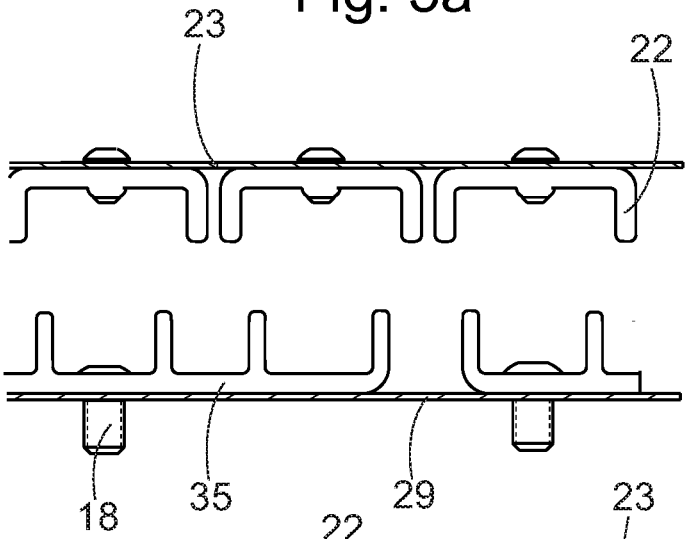
Figure 5C:
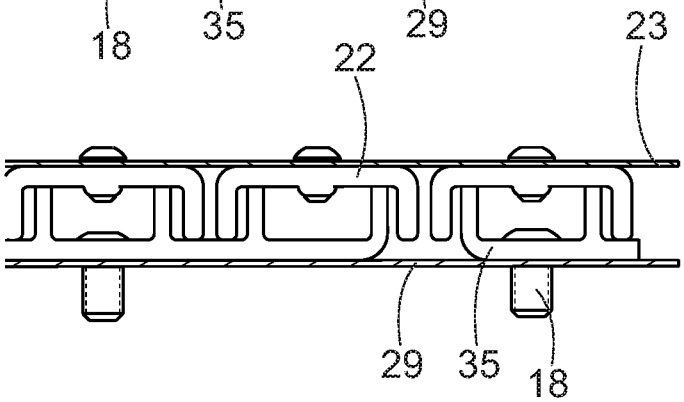
Figure 5D:
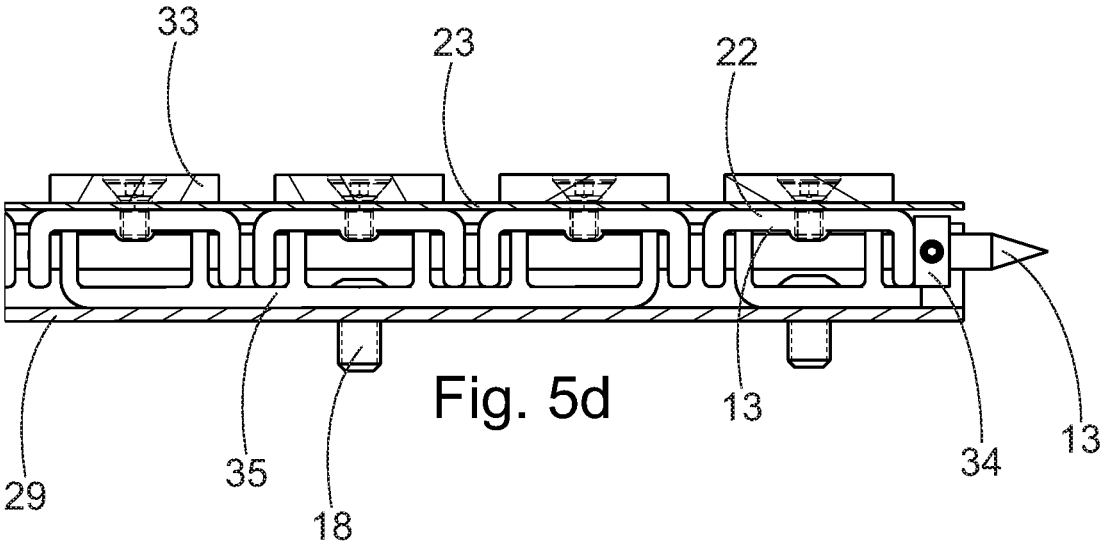

FIG. 5*a* shows a bottom view of the doctor arrangement according to the invention, FIG. 5*b* shows a cross section of the doctor arrangement seen in the machine direction before the brackets are targeted, FIG. 5*c* shows the doctor arrangement of FIG. 5*a* after the brackets are targeted without any pivot rod, FIG. 5*d* shows another embodiment like in FIG. 5*c* fully installed.

FIG. 1 shows the doctor arrangement according to the invention adapted to the vicinity of a surface 10 to be doctored. The doctor arrangement is especially for a fiber web machines such as paper, board, and tissue machines. Here one doctor blade 11 is fixed to a doctor beam 15. Also other kinds of support structures for the doctor blade holder may be used. Here the surface 10 rotates counterclockwise. The surface can be, for example, the surface of a drying cylinder. Then the doctor blade keeps the surface clean. The doctor arrangement is also suitable for doctoring polymer coated rolls, belts, and transfer belts as well as open-surfaced rolls. In a fiber web machine, such as a paper or board or tissue machine, open-surfaced rolls are used for several varied reasons. In a suction roll, for example, the shell is perforated for leading a vacuum effect from the inside of the roll to the outside of it. In other words, in the wet end of the machine, the doctored rolls have some void volume for water to escape. The void volume can be grooves, blind holes and/or through holes. Whereas in the dry end and finishing part of the machine most of the doctored rolls have a smooth surface. The holes make the shell open-surfaced. On the other hand, grooved rolls are also used, in which the shell surface is grooved mainly for improving dewatering. A suction roll with a grooved surface also exists, the shell of which is provided with both holes and grooves. In addition to or instead of grooves, blind bores, for example, can be used. Soft coatings are also used in the rolls while belts and transfer belts are soft surfaced by their nature. In addition, the surface of a belt, for example, can be grooved. The doctor blade removes water and impurities from the surface. Also, the doctor blade may remove the fiber web off the surface.

In practice, in the center roll doctoring is crucial. So, there are even two consequent doctor blade at one roll.

The modern doctor arrangement includes a blade holder 12 arranged pivotably by a pivot rod 13 supported to brackets 14. In this way, only the blade holder pivots with the doctor blade. In the embodiment of FIG. 1, the doctor beam 15 is a rigid structure. The doctor beam 15 is supported at its ends and there are setting means for adjusting the angle of the doctor beam 15 (not shown). The actual loading of the doctor blade is done by pivoting the blade holder.

FIGS. 2*a* and 2*b* show a known bracket for a pivot rod in a doctor arrangement. This bracket is made of sheet metal, and it has disadvantages as previously stated. The bracket 14 has a base 16 with a mounting aperture 17. By using a bolt 18 the bracket 14 is fixed to a doctor beam 15 or other suitable support structure. The bracket has also adjacent ears 19 with a hole 20 arranged perpendicular to the base 16. In FIG. 2*c*, a pivot rod 13 is led though the holes 20. On the left, one loading finger 21 is shown, and the pivot rod 13 goes through the loading finger 21, which is fixed to a top plate 23. Then there are two top brackets 22 also fixed to the top plate 23. These top brackets are like the bracket 14 as a base bracket bolted to the doctor beam. Thus the top plate and the doctor blade installed thereto can pivot.

According to the invention, the bracket 14 is a cast or 3D-printed piece. In this way many advantages are achieved. First, the bracket is extremely rigid. This makes the whole blade holder stiffer than before. Then the bracket can be designed more freely. Advantageously, there is a thickening 24 in connection with the base 16 and the ear 19. In other words, the corners are stiff, and they have good load capacity.

Simultaneously, the ears, holes and apertures may be designed independently. The base can also be a bit wider than the ears giving extra support for the loading tubes and add rigidity too. The base can wider and/or longer than the ears. This enables many advantageous features, i.e. rigidity by adding material in the strategic points, material also let you have openings for the opposite ears to lower the structure and reach below the corners of the loading tubes to support those.

The brackets according to the invention are shown in FIG. 3*a* in 3D. The bracket may be used as a base bracket or top bracket, and they have same basic properties. Thus the bracket means either one of shown bracket unless otherwise stated. However, the base bracket functions also with the loading finger and other kind of supports fixed to the top plate. Preferably, the bracket 14 has 3-8, preferably 4-6 ears 19. Thus there are much more ears compared to the known technology, which increases the rigidity. And more, the bracket 14 has more than one mounting aperture 17. Thus the bracket can be fixed more firmly. Here the base bracket 35 has three mounting apertures 17 one of which is in the middle. The base bracket 35 is also here such dimensioned that the middle mounting aperture 17 hits the threads in the doctor beam in 150 mm interval. Thus this new kind of bracket may be installed without changes to the doctor beams. If necessary, more threads may be machined and use more than one bolt with one bracket. Thus, the bracket 14 has two or three mounting aperture 17.

Advantageously, the bracket 14 has round corners. Also other shapes are round. In this way, the installation is safe. Also, the loading tubes avoid damages being in contact with the brackets. Actually, since there are more ears, the brackets support and contour to the shape of the loading tubes. In other words, the bracket has a curved shape contouring loading tubes included in the doctor arrangement. This fact significantly reduces the wear of the loading tubes and extends the service life of loading tubes, resulting in a prolonged maintenance interval.

Further, the base 16 has a recess 25 for an opposite bracket. In the embodiment of FIG. 3*a*, the recess 25 is a through hole. The recess is so dimensioned and positioned, that a part of the opposite ear may enter the recess. Thus the opposite bracket may be installed closer than before and thereby lower the whole doctor assembly. Simultaneously, the stress to the brackets decreases, so that the brackets will not get broken that soon as in the prior art. At the same time, the loading of the lowered and compact structure also works better.

In the shown base bracket 35 the mounting aperture 17 has a counterbore 26 for the bolt. Thus there is room for the bolt even the bolt is in line of the pivot rod, like in FIGS. 4*b* and 4*c*. On contrary, the mounting aperture 17 may be arranged with an offset to the hole 20. This is realized in the top bracket having two mounting apertures 17 arranged on a line 27 perpendicular to another line 28 extending through the holes 20. In this way, the pivot rod goes between the mounting apertures 17. Advantageously, the mounting aperture 17 has an internal thread. Again, this is realized in the top bracket. In this way, the brackets are easy to screw to the top plate. Internal threads may be arranged to the base bracket also, but then the bolt should go through the doctor beam or other doctor blade holder support structure in question.

FIG. 4*a* shows the doctor arrangement according to the invention from above. Also two embodiments are shown simultaneously. These embodiments are shown separately in FIGS. 4*b* and 4*c*. Apart from the embodiment in question, the doctor arrangement is fixed to the doctor beam 15 with several bolts 18. Here there is also a base plate 29 forming support to loading tubes 30. During installation, the base plate is first attached with bolts through aperture of the brackets. The base plate 29 may consist of several parts arranged end to end, like in FIG. 5*a*. Here the base plate 29 has elongated holes 31 for bolts with 150 mm interval. Thus this new kind of doctor assembly can be easily installed to the existing doctor beams.

Then there is a top plate 23 with top brackets 22 and a jaw part 32 also screwed to the top plate 23. The doctor blade 11 is supported by a blade holder 12, which includes a top plate 23 and a jaw part 32. Here the jaw part 32 is a separate piece screwed to the top plate 23. In other words, loading fingers are redundant. However, the bracket according to the invention can be use with various kinds of blade holder. Between the base plate and top plate there is a loading tube 30 on both side of the pivot rod 13. Thus the blade holder 12 may be pivoted back and forth, and thereby load and unload the doctor blade against the surface. The loading tubes are usually positioned after installing the base plate. Then the blade holder is positioned, and the pivot rod is installed and locked in place (FIG. 5*d*).

The doctor blade 11 as well as the doctor arrangement has a length of several meters, from 1 to 11 meter extending in cross-machine direction. The doctor blade has a width from 5 to 20 centimeters extending in machine direction. FIGS. 4*b*-4*e* show different types of form locking for the doctor blades. Also other kind of doctor blades may be used, like foil blades (not shown). There can also be stiffening fingers 33 on top of the top plate 23. Then the top plate is stiff in the loading direction but can still adapt to the roll surface. Also the heads of the screws are hidden avoiding thereby the wearing of said heads.

The loading tubes 30 are provided between the top plate 23 and the base plate 29. Here the doctor blade 11 is loaded by pressurizing the hindmost loading tube 30. Correspondingly, the doctor blade can be detached from the surface to be doctored by simultaneously depressurizing the hindmost tube 30 and pressurizing the anterior tube 30 for a doctor blade replacement, for example. The doctor blade may be pull sideways from the blade holder and push back the new one. With a blade holder design of FIGS. 4*b* and 4*c* utilizing the top plate 23, the supporting and loading effect of the blade holder 12 can be extended sufficiently far.

In FIG. 5*a*, the elongated holes 31 are in 150 mm interval. In this way the base plate with the brackets may be installed in the existing threads. FIG. 5*a* shows three base brackets 35. One has six ears, and it will be fixed with one bolt. The other two brackets are shorter, but surprisingly cut out of a long bracket thereby including four and two ears, respectively. In this way, one mold is sufficient to manufacture the bracket and different length of doctor arrangements can be covered with one kind of bracket. In FIG. 5*b*-5*d* the rightmost base bracket 35 is cut-out just like in FIG. 5*a*.

In FIG. 5*d*, the outermost base bracket 35 is cut-out, but the next is a uniform base bracket 35 with six ears. Here, also stiffening fingers 33 are screwed on top of the top plate 23. The pivot rod 13 has conical tip for facilitating the installation of the pivot rod. At the end, the pivot rod 13 is secured with a lock piece 34.

The novel doctor arrangement can be taken into use without major equipment changes or investments. Also, the doctor arrangement can be installed even in tight positions. In most cases, it is sufficient to changes only the base brackets to repair the doctor assembly. Advantageously, also the shown top brackets are used. With the new brackets, there are brackets side by side, not only in 150 mm interval. This stiffens the doctor assembly further. Also, the pivot rod may be more flexible since the distance between two ears is short.

The invention claimed is:

1. Bracket for a pivot rod in a doctor arrangement for cleaning the roll surface of a roll in a fiber web machine, which bracket has a base with a mounting aperture and adjacent ears with a hole for a pivot rod arranged perpendicular to the base, wherein the bracket is one of a cast or 3D-printed piece, wherein the base has a recess dimensioned and positioned so that a part of an ear of an opposite bracket may enter the recess.

2. Bracket according to claim 1, wherein the bracket has at least three ears.

3. Bracket according to claim 2, wherein the bracket has at least four ears.

4. Bracket according to claim 1, wherein the bracket has more than one mounting aperture.

5. Bracket according to claim 1, wherein the bracket has round corners.

6. Bracket according to claim 1, wherein the recess is a through hole.

7. Bracket according to claim 1, wherein the mounting aperture is arranged with an offset to the hole.

8. Bracket according to claim 1, wherein there is a thickening in connection with the base and the ear.

9. Bracket according to claim 1, wherein the mounting aperture has an internal thread.

10. Bracket according to claim 1, wherein the base has two mounting apertures.

11. Bracket according to claim 10, wherein said two mounting apertures are arranged on a line perpendicular to another line extending through the holes.

12. Doctor arrangement for a fiber web machine, which doctor arrangement includes a blade holder arranged pivotably by a pivot rod supported to brackets, wherein each bracket is a bracket according to claim 1.

13. Doctor arrangement according to claim 12, wherein there are brackets side by side.

14. Doctor arrangement according to claim 12, wherein the bracket is screwed directly on a top plate.

15. Doctor arrangement according to claim 12, wherein the bracket has a curved shape contouring loading tubes included in the doctor arrangement.

* * * * *